US008224646B2

(12) United States Patent
Tokuda et al.

(10) Patent No.: US 8,224,646 B2
(45) Date of Patent: Jul. 17, 2012

(54) SPEECH SYNTHESIZING DEVICE, METHOD AND COMPUTER PROGRAM PRODUCT

(75) Inventors: Ryutaro Tokuda, Kanagawa (JP); Takehiko Kagoshima, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 325 days.

(21) Appl. No.: 12/563,551

(22) Filed: Sep. 21, 2009

(65) Prior Publication Data

US 2010/0211392 A1 Aug. 19, 2010

(30) Foreign Application Priority Data

Feb. 16, 2009 (JP) ..... 2009-032541

(51) Int. Cl.
*G10L 13/00* (2006.01)

(52) U.S. Cl. ..... 704/258; 704/260; 704/267

(58) Field of Classification Search ..... 704/258, 704/260, 267
See application file for complete search history.

(56) References Cited

U.S. PATENT DOCUMENTS 4,338,490 A * 7/1982 Masuzawa et al. ..... 704/263
4,885,790 A * 12/1989 McAulay et al. ..... 704/265
5,845,047 A * 12/1998 Fukada et al. ..... 704/268
6,006,175 A * 12/1999 Holzrichter ..... 704/208
6,833,841 B2 * 12/2004 Matsumoto ..... 345/634
7,969,901 B2 * 6/2011 Degenhardt et al. ..... 370/252
7,989,976 B2 * 8/2011 Diab et al. ..... 307/2
8,082,484 B2 * 12/2011 Choi et al. ..... 714/784
2003/0033145 A1 * 2/2003 Petrushin ..... 704/236
2003/0093273 A1 * 5/2003 Koyanagi ..... 704/237
2009/0204403 A1 * 8/2009 Hollander et al. ..... 704/260

FOREIGN PATENT DOCUMENTS

JP 09-061197 3/1997

* cited by examiner

*Primary Examiner* — Jakieda Jackson
(74) *Attorney, Agent, or Firm* — Turocy & Watson, LLP

(57) ABSTRACT

The speech synthesizing device acquires numerical data at regular time intervals, each piece of the numerical data representing a value having a plurality of digits, detects a change between two values represented by the numerical data that is acquired at two consecutive times, determines which digit of the value represented by the numerical data is used to generate speech data depending on the detected change, generates numerical information that indicates the determined digit of the value represented by the numerical data, and generates speech data from the digit indicated by the numerical information.

6 Claims, 8 Drawing Sheets

| TIME | 0 | 1 | 2 | 3 | 4 | 5 | ··· |
|---|---|---|---|---|---|---|---|
| NUMERICAL DATA | 567 | 568 | 569 | 570 | 571 | 572 | ··· |
| TEXT | 567 | 8 | 9 | 70 | 1 | 2 | ··· |

| TIME | 0 | 1 | 2 | 3 | 4 | 5 | 6 | 7 | ··· |
|---|---|---|---|---|---|---|---|---|---|
| NUMERICAL DATA | 567 | 566 | 565 | 564 | 565 | 566 | 567 | 568 | ··· |
| TEXT | 567 | 6 | 5 | 4 | 5 | 566 | 7 | 8 | ··· |

| TIME | 0 | 1 | 2 | 3 | 4 | 5 | 6 | 7 | ··· |
|---|---|---|---|---|---|---|---|---|---|
| NUMERICAL DATA | 567 | 566 | 565 | 564 | 565 | 566 | 567 | 568 | ··· |
| TEXT | 567 | 6 | 5 | 4 | 5 | 566 | 7 | 8 | ··· |
| VOICE PITCH | 5 | 3 | 3 | 3 | 7 | 7 | 7 | 7 | ··· |

FIG.9

| TIME | NUMERICAL DATA | TEXT |
|---|---|---|
| 0 | 567 | <prosody loud="default">567</prosody> |
| 1 | 566 | <prosody loud="low">6</prosody> |
| 2 | 565 | <prosody loud="low">5</prosody> |
| 3 | 564 | <prosody loud="low">4</prosody> |
| 4 | 565 | <prosody loud="high">5</prosody> |
| 5 | 566 | <prosody loud="high">6</prosody> |
| 6 | 567 | <prosody loud="high">7</prosody> |
| 7 | 568 | <prosody loud="high">8</prosody> |
| ⋮ | ⋮ | ⋮ |

FIG.11

| TIME | NUMERICAL DATA | TEXT |
|---|---|---|
| 0 | 567 | 567 |
| 1 | 566 | 6 |
| 2 | 565 | 5 |
| 3 | 564 | 4 |
| 4 | 565 | 5 |
| 5 | 566 | <prosody rate="fast">56</prosody><br><prosody rate="default">6</prosody> |
| 6 | 567 | 7 |
| 7 | 568 | 8 |
| ⋮ | ⋮ | ⋮ |

SPEECH SYNTHESIZING DEVICE, METHOD AND COMPUTER PROGRAM PRODUCT

CROSS-REFERENCE TO RELATED APPLICATIONS

This application is based upon and claims the benefit of priority from the prior Japanese Patent Application No. 2009-032541, filed on Feb. 16, 2009; the entire contents of which are incorporated herein by reference.

BACKGROUND OF THE INVENTION

1. Field of the Invention

The present invention relates to a speech synthesizing device, method, and computer program product for outputting values that change with time by means of voice.

2. Description of the Related Art

Conventionally, measurement result output devices that automatically read out values obtained as measurement results by measurement equipment at regular time intervals (measurement values) have been suggested (see JP-A 9-61197 (KOKAI), for example). By use of such a measurement result output device, the user can be informed of measurement values by means of voice without averting his/her eyes from a subject of a job that requires grasping of measurement results, and the user can thereby concentrate on the job.

When the measurement value rapidly changes; however, the value may change at a moment it is read out. Then, the read out value is no longer a real-time value, which causes incorrect correspondence between the measurement time and the measurement value. In other words, the user may not be informed of the measurement value in a timely manner.

SUMMARY OF THE INVENTION

According to an aspect of the present invention, a speech synthesizing device includes an acquiring unit configured to acquire numerical data at regular time intervals, each piece of the numerical data representing a value having a plurality of digits; a detecting unit configured to detect a change in values represented by the numerical data acquired at two consecutive times; a determining unit configured to determine, depending on the change, which digit of the value is used to generate speech data; a generating unit configured to generate numerical information that indicates the digit of the value; and a speech synthesizing unit configured to generate speech data from the digit indicated by the numerical information.

According to another aspect of the present invention, a speech synthesizing method is performed by a speech synthesizing device that includes an acquiring unit, a detecting unit, a determining unit, a generating unit, and a speech synthesizing unit. The method includes acquiring, by the acquiring unit, numerical data at regular time intervals, each piece of the numerical data representing a value having a plurality of digits; detecting, by the detecting unit, a change in values represented by the numerical data acquired at two consecutive times; determining, by the first determining unit, which digit of the value is used to generate speech data, depending on the change; generating, by the generating unit, numerical information that indicates the digit of the value; and generating, by the speech synthesizing unit, speech data from the digits indicated by the numerical information.

According to still another aspect of the present invention, a computer program product has a computer readable medium including programmed instructions. The instructions, when executed by a computer, cause the computer to perform acquiring numerical data at regular time intervals, each piece of the numerical data representing a value having a plurality of digits; detecting a change in values represented by the numerical data acquired at two consecutive times; determining which digit of the value is used to generate speech data, depending on the change; generating numerical information that indicates the digit of the value; and generating speech data from the digits indicated by the numerical information.

BRIEF DESCRIPTION OF THE DRAWINGS

FIG. 9 is a diagram in which texts with a tag inserted by a tag inserting unit 108 according to the third embodiment are visualized in tabular form;

FIG. 11 is a diagram in which texts with a tag inserted by the tag inserting unit 108 according to a modified example of the third embodiment are visualized in tabular form.

DETAILED DESCRIPTION OF THE INVENTION

Exemplary examples of a speech synthesizing device, method and computer program product according to the present invention are explained in detail below with reference to the accompanying drawings.

First, the hardware structure of a speech synthesizing device according to the present embodiments is explained. The speech synthesizing device has a hardware structure incorporating a regular computer, and includes a control unit that controls the entire device such as a central processing unit (CPU), a first storage unit such as a read only memory (ROM) and a random access memory (RAM) that stores therein various types of data and various programs, a second storage unit such as a hard disk drive (HDD) and a compact disk (CD) drive that stores therein various types of data and various programs, and a bus that connects these components to one another. In the speech synthesizing device, a displaying unit that displays information, an operation input unit such as a keyboard and a mouse that receives instructions input by the user, a communication interface that controls communications with external devices, and a speaker that outputs speech are connected to one another, either by way of cable or wirelessly. According to the present embodiments, a measurement apparatus is connected as an external device to the device. The measurement apparatus is to measure physical quantities such as temperatures, altitudes, speeds, accelerations, light levels, voltages, heart rates, lengths of time, lengths of objects, and quantities of objects. The measurement apparatus outputs the value of a physical quantity (measurement value) that is measured, and sends numerical data that represents digits of the measurement value to the speech synthesizing device at predetermined time intervals so that the numerical data is input to the speech synthesizing device. The measurement value is a real number such as a natural number, an integer, a decimal number, and a fraction.

Figures 1, 2:
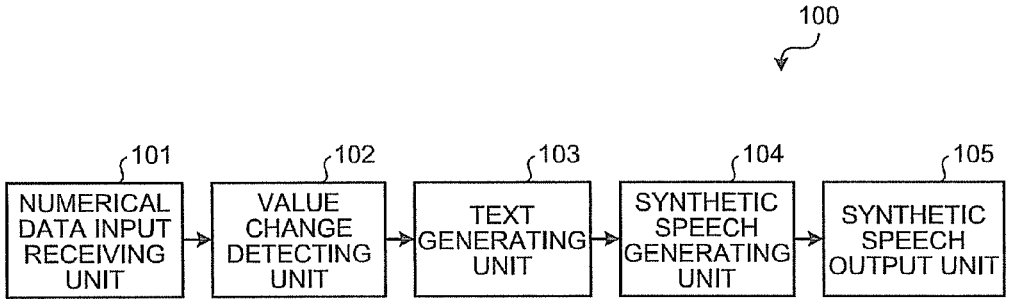
FIG. 1 is a diagram showing an example functional structure of a speech synthesizing device 100 according to a first embodiment.
FIG. 2 is a diagram in which texts generated by a text generating unit 103 according to the first embodiment are visualized in tabular form.

Various functions that are executed when the CPU of the speech synthesizing device having the above hardware structure executes various programs stored in the storage device or an external storage device are explained below. FIG. 1 is a diagram showing an example functional structure of the speech synthesizing device 100. The speech synthesizing device 100 includes a numerical data input receiving unit 101, a value change detecting unit 102, the text generating unit 103, a synthetic speech generating unit 104, and a synthetic speech output unit 105. These units are realized in the first storage unit such as a RAM when the CPU implements the program.

The numerical data input receiving unit 101 receives the numerical data every time the measurement apparatus sends it at predetermined time intervals. The value change detecting unit 102 detects any change between measurement values represented by the numerical data that is received by the numerical data input receiving unit 101 at any two consecutive times. More specifically, the value change detecting unit 102 stores the numerical data in the first storage unit such as the RAM every time the numerical data input receiving unit 101 receives the numerical data. Then, the value change detecting unit 102 compares the measurement value represented by this numerical data (current measurement value) with the measurement value represented by the numerical data received and stored immediately before the current numerical data is received (prior measurement value) to detect any digit of a position that has been changed in these values. Based on the detection result obtained by the value change detecting unit 102, the text generating unit 103 determines which digit of the current measurement value should be output by means of voice, and generates a text for the determined digit. Here, the text generating unit 103 determines the detected digit of the position that has been changed and any digits of lower positions thereof are to be output by means of voice. The text here means, for example, numerical information such as a number code representing a number.

FIG. 2 is a diagram in which texts generated by the text generating unit 103 are visualized in tabular form. For example, based on the comparison of a measurement value "568" (current measurement value) that is represented by the numerical data received at a time "1" and a measurement value "567" (prior measurement value) that is represented by the numerical data received immediately before at the previous time "0", the value change detecting unit 102 detects the last digit position as the changed digit position. In this case, the text generating unit 103 generates a text representing the last digit "8" of the measurement value "568" that is represented by the numerical data received at the time "1". Furthermore, when the value change detecting unit 102 compares a measurement value "570" (current measurement value) that is represented by the numerical data received at a time "3" with a measurement value "569" (prior measurement value) that is represented by the numerical data received at the previous time "2", the value change detecting unit 102 detects the last two digit positions as the changed digit positions. Then, the text generating unit 103 generates a text that represents the last two digits "70" of the measurement value "570" that is represented by the numerical data received at the time "3".

The synthetic speech generating unit 104 generates synthetic speech data to indicate by means of voice the value of the text that is generated by the text generating unit 103. Any conventional method can be adopted to generate the synthetic speech data. For example, speech data of speeches corresponding to values "0" to "9" may be pre-stored in the second storage unit such as the HDD so that the synthetic speech generating unit 104 can synthesize speech data from the data corresponding to the values "0" to "9" and generate synthetic speech data to indicate the value of the text by means of voice. The synthetic speech output unit 105 outputs the speech indicated by the synthetic speech data that is generated by the synthetic speech generating unit 104, by way of the speaker.

Figures 3, 4:
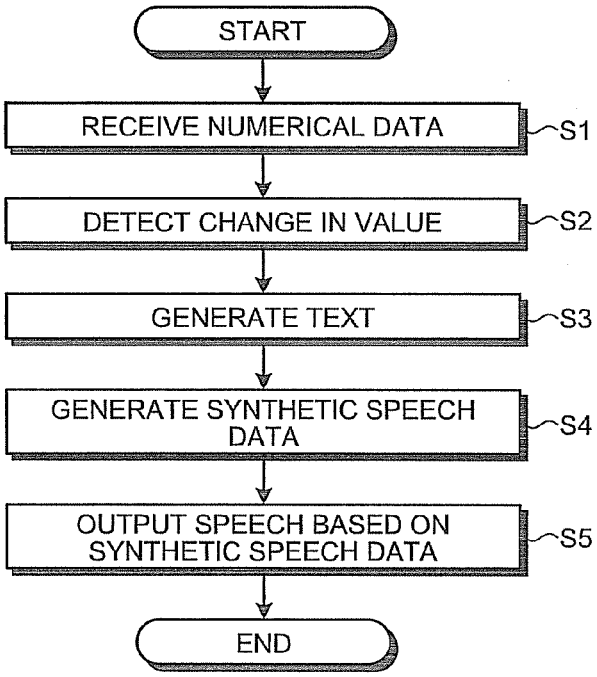
FIG. 3 is a flowchart showing the procedure of a numerical data reading-out process performed by the speech synthesizing device 100 according to the first embodiment.
FIG. 4 is a diagram in which texts generated by the text generating unit 103 according to a modified example, are visualized in tabular form.

Next, a numerical data reading-out process performed by the speech synthesizing device 100 according to the present embodiment is explained with reference to FIG. 3. At step S1, the numerical data input receiving unit 101 receives the numerical data transmitted by the measurement apparatus. At step S2, the value change detecting unit 102 compares the measurement value represented by this numerical data (current measurement value) with the measurement value represented by the numerical data received at step S1 immediately before the current numerical data is received (prior measurement value), and detects any digits of positions that have been changed. At step S3, the text generating unit 103 generates a text that indicates the changed digits of the positions detected at step S2 of the current measurement value received at step S1, and any lower digits thereof. At step S4, the synthetic speech generating unit 104 generates the synthetic speech data that indicates, by means of voice, the value of the text that is generated at step S3. At step S5, the synthetic speech output unit 105 outputs the speech based on the synthetic speech data generated at step S4, by way of the speaker.

In the above manner, a measurement value that changes in accordance with time is compared with a measurement value that is obtained immediately before, and a changed digit of a position of the measurement value and any digits of power positions are output by means of voice. In other words, digits of upper positions of the measurement value that are not changed are eliminated from the voice output so that, even when the measurement value rapidly changes, the measurement value becomes a real-time value. Thus, the correspondence between the measurement time and the measurement value can be accurately maintained. As a result, the user can be informed of the measurement value in a timely manner.

If some, but not all, of the digits of the current measurement value are detected as being changed for a predetermined period of time or at a predetermined number of detections, the text generating unit 103 may be configured to determine that all the digits of the current measurement value should be output by means of voice and to generate a text for these digits. FIG. 4 is a diagram in which the texts generated by the text generating unit 103 that is configured in such a manner are visualized in tabular form. Here, it is assumed that the predetermined number of detections is set to five. It is also assumed that changes in the measurement value at times 0 to 7 are the digit of the last position only. When the change in the digit of the last position is detected for five consecutive times, the text generating unit 103 generates, at the time 5, a text indicating all the digit of the current measurement value received at this time.

In this manner, even when the measurement value rapidly varies but digits of only certain positions of the value keep changing, the entire digits of the value are output by means of voice in midstream. Therefore, the user can be informed not only of the measurement value in a timely manner, but also of all the digits of the value in a reliable manner.

Next, a speech synthesizing device, a method, and a computer program product according to a second embodiment are explained now. For the components that are the same as those of the first embodiment, the same reference numerals are used in the explanation, or they may be simply omitted from the explanation.

According to the present embodiment, the speech synthesizing device is configured to change at least one of prosodic forms such as the stress, length, and rise/fall of the voice, the utterance speed, the degree of intonation, the quality of the voice, and the volume of the voice, depending on the rate of measurement value change when outputting by means of voice a changed digit of a position and any digits of lower positions thereof of a measurement value.

Figures 5, 6:
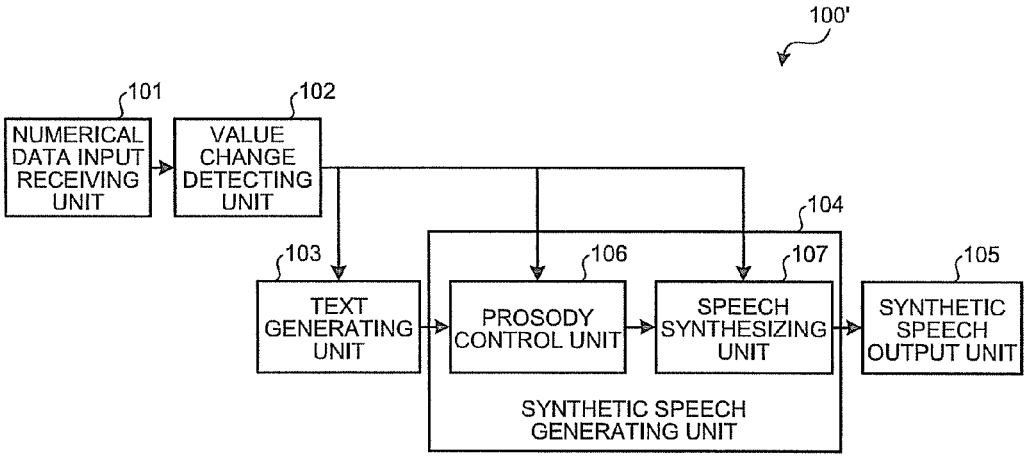
FIG. 5 is diagram showing an example functional structure of a speech synthesizing device 100' according to a second embodiment.
FIG. 6 is a diagram in which prosodic features determined by a prosody control unit 106 for texts generated by the text generating unit 103 according to the second embodiment are visualized in tabular form.

FIG. 5 is a diagram showing an example functional structure of a speech synthesizing device 100' according to the second embodiment. The speech synthesizing device 100' according to the present embodiment includes the numerical data input receiving unit 101, the value change detecting unit 102, the text generating unit 103, the synthetic speech generating unit 104, and the synthetic speech output unit 105. The functions of the numerical data input receiving unit 101 and the synthetic speech output unit 105 are the same as the corresponding units of the first embodiment.

In a similar manner to the first embodiment, the value change detecting unit 102 compares the current measurement value with the prior measurement value and detects any changed digits of positions. In addition, the value change detecting unit 102 according to the present embodiment detects the rate of the current measurement value change with reference to the prior measurement value. The difference between the prior measurement value and the current measurement value or the ratio of the current measurement value to the prior measurement value may serve as the change rate.

In the same manner as the modified example of the first embodiment, when the detection of some, but not all, of the digits of the value as being changed lasts shorter than a predetermined period of time or occurs less than the predetermined number of times, the text generating unit 103 determines that only the changed digit of the position and any digits of lower positions thereof of the current measurement value should be output by means of voice, and generates a text indicating these digits. When the detection of some, but not all, of the digits of the current measurement value as being changed lasts for a predetermined period of length or longer, or occurs at a predetermined number of times or more, the text generating unit 103 determines that all the digits of the current measurement value should be output by means of voice, and generates a text indicating all these digits.

The synthetic speech generating unit 104 includes the prosody control unit 106 and a speech synthesizing unit 107. The prosody control unit 106 determines, for a text generated by the text generating unit 103, at least one of the prosody, the utterance speed, the degree of intonation, the quality of voice, and the volume of voice, depending on the change rate detected by the value change detecting unit 102. Here, it is assumed that the prosody control unit 106 determines the rise/fall of the voice (voice pitch) as a prosodic form. For example, when the rate of measurement value change shows a declining tendency that the current measurement value decreases from the prior measurement value, the prosody control unit 106 lowers the pitch of the voice when outputting by mans of voice the changed digit of a position and any digits of lower positions of the current measurement value, with respect to the changed digit of the position and any digits of the lower positions of the prior measurement value. In addition, when the rate of measurement value change shows the rising tendency that the current measurement value increases from the prior measurement value, the prosody control unit 106 raises the pitch of the voice when outputting by means of voice the changed digit of the position and any digits of lower positions of the current measurement value, with respect to the changed digit of the position and any digits of the lower positions of the prior measurement value.

Moreover, for example, when the rate of measurement value change shifts from a no-change state or the rising tendency to the declining tendency, the prosody control unit 106 lowers the pitch of the voice when outputting by means of voice the changed digit of the position and any digits of the lower positions of the current measurement value, with respect to the changed digit and any digits of the lower positions of the prior measurement value. When the rate of measurement value change shifts from the no-change state or the declining tendency to the rising tendency, the prosody control unit 106 raises the pitch of the voice when outputting by means of voice the changed digit of the position and any digits of the lower positions of the current measurement value, with respect to the changed digit of the position and any digits of the lower positions of the prior measurement value.

FIG. 6 is a diagram in which the prosodic features determined for the texts generated by the text generating unit 103 by the prosody control unit 106 are visualized in tabular form. At a time "0", no change can be detected in the measurement value. Thus, the text generating unit 103 generates a text indicating all the digits "567" of the measurement value "567" that is represented by the numerical data received at the time "0". Then, the prosody control unit 106 determines that the pitch of the voice for outputting the value "567" should be at a standard level of "5". For a measurement value "566" that is represented by the numerical data received at a time "1", the text generating unit 103 generates a text indicating the last digit "6". This measurement value "566" is smaller than the measurement value "567" represented by the numerical data received at the time "0", and therefore the rate of measurement value change is shifted from the no-change state to the declining tendency. Thus, the prosody control unit 106 determines that the pitch of the voice for outputting the digit "6" should be at level "3", which is lower than the standard level. For the measurement value "565" that is represented by the numerical data received at a time "2", the text generating unit 103 generates a text indicating the last digit "5". The measurement value "565" is smaller than the measurement value "567" represented by the numerical data received at the time "1", and therefore the rate of measurement value change is still on the decline. In this case, the prosody control unit 106 determines that the pitch of the voice for outputting the value "6" should be at level 3 that is lower than the standard level, in the same manner as the time "1". The same holds for the time "3". For the measurement value "565" that is represented by the numerical data received at a time "4", the text generating unit 103 generates a text indicating the last digit "5". The measurement value "565" is greater than the measurement value "564" that is represented by the numerical data received at the time "3", which means that the rate of measurement value change is shifted from the declining tendency to the rising tendency. In this case, the prosody control unit 106 determines that the pitch of the voice for outputting the value "5" should be at level "7", which is higher than the standard level. For the measurement value "566" that is represented by the numerical data received at the time "5", because the last digit is detected as a changed digit for five consecutive times, the text generating unit 103 generates a text indicating all the digits, "565", of the measurement value. In addition, because the measurement value "566" is greater than the measurement value "565" that is represented by the numerical value received at the time "4", the rate of measurement value change is on the rise. In this case, the prosody control unit 106 determines in the same manner as the time "4" that the pitch of the voice for outputting the value "566" should be at level "7", which is higher than the standard level.

The speech synthesizing unit 107 generates synthetic speech data that represents a speech having the prosodic feature determined by the prosody control unit 106 for the value of the text generated by the text generating unit 103. When generating the synthetic speech data, the speech synthesizing unit 107 synchronizes the value with the prosodic feature determined for this value, in accordance with the time.

Figure 7:
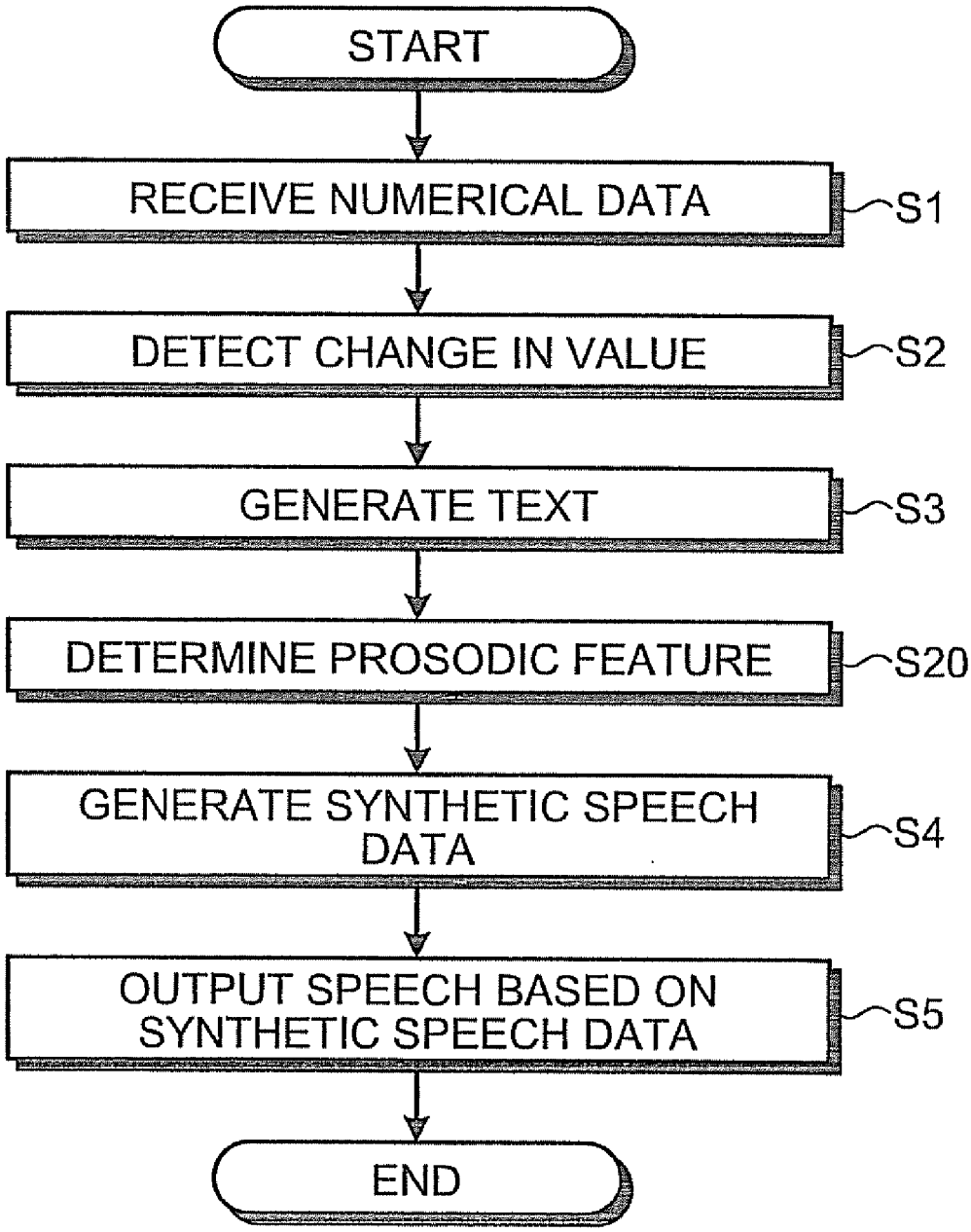
FIG. 7 is a flowchart showing the procedure of a numerical data reading-out process performed by the speech synthesizing device 100' according to the second embodiment.

The procedure of a numeric data reading-out process performed by the speech synthesizing device 100' according to the present embodiment is now explained with reference to FIG. 7. The operation at step S1 is the same as the corresponding step according to the first embodiment. At step S2, the value change detecting unit 102 detects any changed digit of a position of the measurement value by comparing the current measurement value with the prior measurement value, and also detects the rate of measurement value change. At step S3, the text generating unit 103 generates the text indicating the digit of the position detected as being changed at step S2 and any digits of lower positions thereof of the current measurement value received at step S1. However, when the detection of the same digit lasts a predetermined period of time or occurs at the predetermined number of times, the text generating unit 103 generates the text that indicates, not the digit detected at step S2 and the digits of lower positions, but all the digits of the value. At step S20, the prosody control unit 106 determines the prosodic feature for the text generated at step S3, depending on the change rate detected at step S2. At step S4, the speech synthesizing unit 107 generates the synthetic speech data having the prosodic feature determined at step S20 for the value of the text generated at step S3. The operation at step S5 is the same as the corresponding step of the first embodiment.

By changing the prosodic feature depending on the rate of measurement value change, the user can be informed of the measurement value in a timely manner even when the number of digits for outputting the measurement value by means of voice is reduced. The user also becomes roughly but intuitively aware of the rate of measurement value change, based on the change in the prosodic feature.

Next, a speech synthesizing device, a method, and a computer program product according to the third embodiment are explained. For the same components as those of the first or second embodiment, the same reference numerals are used in the explanation, and the explanation may be simply omitted.

The speech synthesizing device 100' according to the second embodiment is configured to output the speech by varying at least one of the prosody, the utterance speed, the degree of intonation, the quality of voice, and the volume of voice, depending on the rate of measurement value change. In the speech synthesizing device according to the third embodiment, the change in the prosodic feature, the utterance speed, the degree of intonation, the quality of voice, and the volume of voice depending on the rate of measurement value change is performed by inserting a tag into a text.

Figure 8:
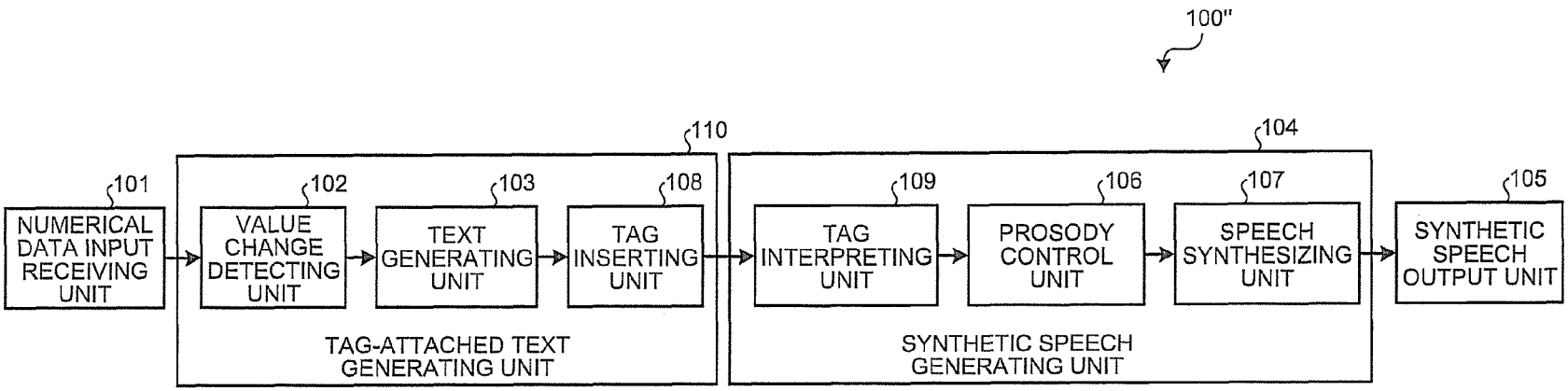
FIG. 8 is a diagram showing an example functional structure of a speech synthesizing device 100" according to a third embodiment.

FIG. 8 is an example functional structure of the speech synthesizing device 100" according to the third embodiment. The speech synthesizing device 100" according to the present embodiment includes the numerical data input receiving unit 101, a tag-attached text generating unit 110, the synthetic speech generating unit 104, and the synthetic speech output unit 105. The numerical data input receiving unit 101 and the synthetic speech output unit 105 have the same functions as those of the first embodiment.

The tag-attached text generating unit 110 includes the value change detecting unit 102, the text generating unit 103, and the tag inserting unit 108. The functions of the value change detecting unit 102 and the text generating unit 103 are the same as those of the second embodiment. The tag inserting unit 108 determines the prosodic feature, the utterance speed, the degree of intonation, the quality of voice, and the volume of voice depending on the change rate detected by the value change detecting unit 102, and inserts a tag designating the determination result as a parameter, into a text generated by the text generating unit 103. For example, the tag inserting unit 108 determines that the utterance speed should be increased when the change rate shows the rising tendency, while the utterance speed should be reduced when the change rate shows the declining tendency. The tag inserting unit 108 also determines that the degree of intonation should be increased when the change rate shows the rising tendency, and that the degree of intonation should be lowered when the change rate shows the declining tendency. Here, in the same manner as the prosody control unit 106 according to the second embodiment, the tag inserting unit 108 determines the pitch of the voice as a prosodic form.

FIG. 9 is a diagram in which texts to which a tag is inserted by the tag inserting unit 108 are visualized in tabular form. For the measurement value "567" that is represented by the numerical data received at the time "0", the tag inserting unit 108 determines that the pitch of the voice for outputting all the digits "567" should be at a standard level. For the measurement value "566" that is represented by the numerical data received at the time "1", the tag inserting unit 108 determines that the pitch of the voice for outputting the last digit "6" of the value should be at a lower level than the standard. For the measurement value "565" that is represented by the numerical data received at the time "4", the tag inserting unit 108 determines that the pitch of the voice for outputting the last digit "5" of the value should be at a higher level than the standard.

The synthetic speech generating unit 104 includes a tag interpreting unit 109, the prosody control unit 106, and the speech synthesizing unit 107. The tag interpreting unit 109 interprets the tag inserted by the tag inserting unit 108 into the text generated by the text generating unit 103, and interprets a parameter designated by this tag. The prosody control unit 106 judges the prosodic feature in accordance with the interpretation result obtained by the tag interpreting unit 109. In the example of FIG. 9, the prosody control unit 106 judges that the pitch of the voice should be lower than the standard level for the digit "6" corresponding to the time "1". Thus, the speech synthesizing unit 107 generates the synthetic speech data having the prosodic feature judged by the prosody control unit 106, for the value of the text generated by the text generating unit 103.

Figure 10:
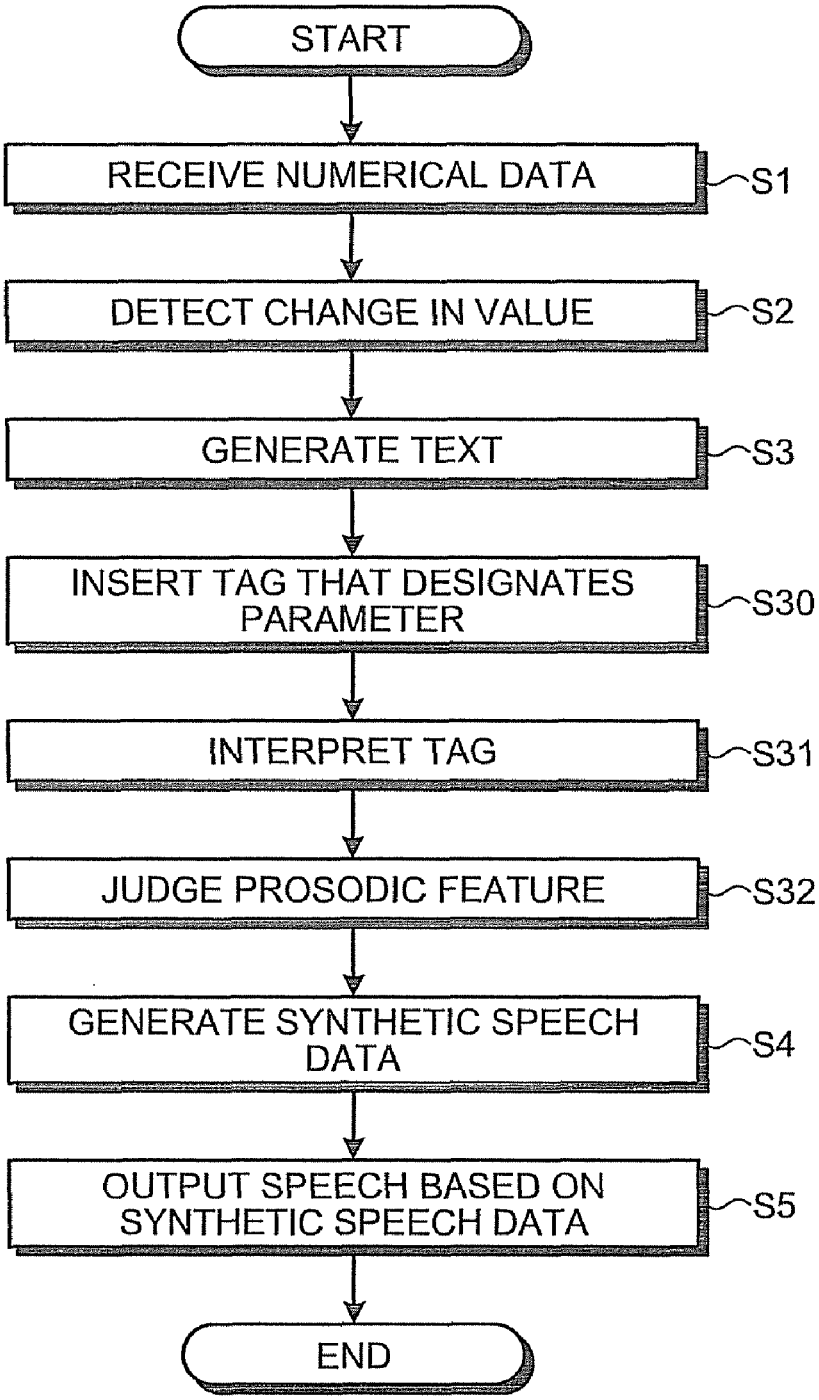
FIG. 10 is a flowchart showing a procedure of a numerical data reading-out process performed by the speech synthesizing device 100" according to the third embodiment.

The procedure of a numerical data reading-out process performed by the speech synthesizing device 100" according to the present embodiment is explained below with reference to FIG. 10. The operation at step S1 is the same as that of the first embodiment. The operations at steps S2 and S3 are the same as those of the second embodiment. At step S30, the tag inserting unit 108 determines the prosodic feature for the text generated at step S3 depending on the change rate detected at step S2, and inserts a tag designating the determined prosodic feature as a parameter. At step S31, the tag interpreting unit 109 interprets the tag inserted at step S30 into the text generated at step S3. At step S32, the prosody control unit 106 judges the prosodic feature from the parameter designated by the tag. At step S4, the speech synthesizing unit 107 generates the synthetic speech data representing the digits of the text generated at step S3, in a voice having the prosodic feature judged at step S32. The operation at step S5 is the same as that of the first embodiment.

The prosodic change that is made depending on the rate of measurement value change is performed by inserting a tag into the text, and a standard tag can be adopted for this purpose. Furthermore, the value is brought into synchronization with the prosodic feature, and therefore any extra control for synchronizing the value with the prosodic feature can be eliminated.

The tag inserting unit 108 of the speech synthesizing device 100" may be configured to determine the prosodic feature for the changed digit of the value and insert a tag that designates the determined prosodic feature as a parameter.

In addition, the speech synthesizing device 100" may be configured in such a manner that, when the detection of a change in a digit of the same position lasts for a predetermined period of time or occurs at a predetermined number of times and thus all the digits of the current measurement value are to be output by means of voice, the digits of upper positions of the value that are not changed may be pronounced faster than the changed digit and the digits of lower positions. FIG. 11 is a diagram in which texts to which the tag inserting unit 108 inserts a tag are visualized in tabular form. When all the digits of a measurement value "566" that is represented by the numerical data received at the time "5" are to be output by means of voice, it is determined that the unchanged upper digits "56" should be pronounced faster than the changed digit and any lower digit, i.e., "6". With such a structure, even when all the digits are to be output by means of voice, the user can be informed of the measurement value in a timely manner, and of all the digits of the measurement value with high accuracy.

The present invention should not be limited to the above embodiments only, but may be realized by modifying the structural components of the embodiments when implementing the invention, without departing from the scope of the invention. In addition, various inventions can be attained by suitably combining some of the structural components disclosed in the embodiments. For example, some of the structural components may be eliminated from the structure of the embodiment. Furthermore, structural components of different embodiments may be suitably combined. The following modifications are practicable.

According to the above embodiments, various programs implemented by the speech synthesizing device 100, 100', or 100" may be stored in a computer connected to a network such as the Internet and downloaded by way of the network. The programs may be stored and offered in an installable or executable file in a computer-readable recording medium such as a CD-ROM, a flexible disk (FD), a CD-R, and a digital versatile disk (DVD).

According to the above embodiments, the value change detecting unit 102 is configured to compare the current measurement value with the prior measurement value. However, the comparison is not limited thereto, and the current measurement value may be compared with any measurement value that is obtained in the past. Moreover, the rate of measurement value change is not limited to the ones described above.

According to the above embodiments, the speech synthesizing device outputs, by means of voice, the digit of the current measurement value that is detected as being changed as a result of the detection performed by the value change detecting unit 102 and any digits of lower positions of the value when the rate of measurement value change is equal to or greater than a predetermined value. When the rate of measurement value change is smaller than the predetermined value, all the digits of the current measurement value may be output by means of voice. With such a structure, the number of digits of the measurement value that are to be output by means of voice is reduced only when the measurement value shows a high change rate. Hence, the measurement value can be informed of in a timely manner, while the output integrity of the measurement value can be maintained.

According to the above embodiments, when the measurement value changes, the speech synthesizing device outputs by means of voice the changed digit of a position of the value and any digits of lower positions only. However, even when the measurement value does not change in accordance with time, not all the digits of the value, but digits of the lowest positions may be output by means of voice.

According to the above embodiments, the speech synthesizing device may determine the utterance speed for outputting the value by means of voice, in accordance with the number of positions of changed digits of the value. In particular, when the number of positions of the changed digits of the value is smaller than the predetermined value, the speech synthesizing device reduces the utterance speed. When the number is equal to or greater than the predetermined value, the speech synthesizing device raises the utterance speed. For example, if digits in three positions of the value have been changed, the speech synthesizing device slows down the utterance. If digits in one hundred positions of the value have been changed, the speed is increased. If a measurement value has a large number of digits, the next measurement value may be measured while the speech for the current value is being output. With the above structure, the correspondence between the measurement time and the measurement value can be always accurately maintained by increasing the utterance speed.

Furthermore, the speech synthesizing device may determine the utterance speed for outputting the value by means of voice, based on the rate of measurement value change and the number of positions of changed digits of the value. In particular, when the rate of measurement value change is equal to or greater than a predetermined value, the speech synthesizing device determines the utterance speed for outputting the value by means of voice in accordance with the number of positions of the changed digits of the value. When the rate of measurement value change is smaller than the predetermined value, the speech synthesizing device does not change the utterance speed in accordance with the number of positions of the changed digits. With such a structure, the utterance speed is increased only when the measurement value has a high change rate and the number of positions of the changed digits is equal to or greater than the predetermined value. Hence, the measurement value can be informed of in a timely manner, while it can be easily understood.

According to the above embodiments, the speech synthesizing device may receive measurement values from more than one measurement apparatus. In such a structure, different voices may be assigned to different measurement apparatus so that all types or some of the types of measurement values may be output by different voices.

According to the above embodiments and modified examples, the predetermined values may be the same or different from one another.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech synthesizing device, comprising:

an acquiring unit configured to acquire numerical data at regular time intervals, each piece of the numerical data representing a value having a plurality of digits;

a detecting unit configured to detect a position of a digit that is changed, by comparing the value represented by the numerical data and a value represented by the numerical data acquired immediately before;

a determining unit configured to determine that the digit detected by the detecting unit and digits of any lower positions thereof of the value represented by the numerical data are used to generate speech data;

a generating unit configured to generate numerical information that indicates the digit and the digits of the lower positions of the value; and a speech synthesizing unit configured to generate speech data from the digit indicated by the numerical information.

2. The device according to claim 1, wherein:

the detecting unit compares the value represented by the numerical data with the value represented by the numerical data acquired immediately before, so as to detect the position of the digit that has been changed and a change rate of the value represented by the numerical data to the value represented by the numerical data acquired immediately before; and the determining unit determines, when the change rate is equal to or greater than a predetermined value, that the digit detected by the detecting unit and the digits of any lower positions thereof of the value represented by the numerical data are used to generate speech data.

3. The device according to claim 1, wherein, when detection of only some of the digits of the value represented by the numerical data as having been changed lasts for a predetermined period of time or occurs for a predetermined number of times, the determining unit determines that all the digits of the value are used to generate speech data.

4. The device according to claim 1, further comprising a speech outputting unit configured to output a speech represented by the generated synthetic speech data.

5. A speech synthesizing method performed by a speech synthesizing device that includes an acquiring unit, a detecting unit, a determining unit, a generating unit, and a speech synthesizing unit, the method comprising:

acquiring, by the acquiring unit, numerical data at regular time intervals, each piece of the numerical data representing a value having a plurality of digits;

detecting, by the detecting unit, a position of a digit that is changed, by comparing the value represented by the numerical data and a value represented by the numerical data acquired immediately before;

determining, by the first determining unit, that the digit detected by the detecting and digits of any lower positions thereof of the value represented by the numerical data are used to generate speech data;

generating, by the generating unit, numerical information that indicates the digit and the digits of the lower positions of the value; and generating, by the speech synthesizing unit, speech data from the digits indicated by the numerical information.

6. A computer program product having a non-transitory computer readable medium including programmed instructions that, when executed by a computer, cause the computer to perform:

acquiring numerical data at regular time intervals, each piece of the numerical data representing a value having a plurality of digits;

detecting, by the detecting unit, a position of a digit that is changed, by comparing the value represented by the numerical data and a value represented by the numerical data acquired immediately before;

determining, by the first determining unit, that the digit detected by the detecting and digits of any lower positions thereof of the value represented by the numerical data are used to generate speech data;

generating numerical information that indicates the digit and the digits of the lower positions of the value; and generating speech data from the digits indicated by the numerical information.

* * * * *